US011780238B2

(12) United States Patent
Åkesson et al.

(10) Patent No.: US 11,780,238 B2
(45) Date of Patent: Oct. 10, 2023

(54) APPARATUS FOR DIGITAL PRINTING OF CARTON-BASED MATERIAL AND A METHOD THEREOF

(71) Applicant: Tetra Laval Holdings & Finance S.A., Pully (CH)

(72) Inventors: Mats Åkesson, Malmö (SE); Anna Harder, Hjärup (SE); Roy Eidebakken, Veberöd (SE); Mats Qvarford, Lund (SE); Daniel Cederström, Limhamn (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 27 days.

(21) Appl. No.: 17/609,028

(22) PCT Filed: May 6, 2020

(86) PCT No.: PCT/EP2020/062509
§ 371 (c)(1),
(2) Date: Nov. 5, 2021

(87) PCT Pub. No.: WO2020/229245
PCT Pub. Date: Nov. 19, 2020

(65) Prior Publication Data

US 2022/0212489 A1 Jul. 7, 2022

(30) Foreign Application Priority Data

May 14, 2019 (EP) ..... 19174363

(51) Int. Cl.
*B41J 3/407* (2006.01)
*B41J 11/00* (2006.01)
*B41M 5/00* (2006.01)

(52) U.S. Cl.
CPC ..... *B41J 3/407* (2013.01); *B41J 11/0021* (2021.01); *B41J 11/00214* (2021.01); *B41M 5/0041* (2013.01)

(58) Field of Classification Search
CPC .. B41J 3/407; B41J 11/0021; B41J 11/00214; B41J 11/0015; B41J 15/005; B41J 15/04; B41J 15/165; B41J 11/002; B41M 5/0041
See application file for complete search history.

(56) References Cited

U.S. PATENT DOCUMENTS 6,052,144 A 4/2000 Reyner
2006/0125899 A1* 6/2006 Cornish ..... B41J 11/0015 347/102

(Continued)

FOREIGN PATENT DOCUMENTS

CN 1240168 A 1/2000
CN 1533901 A 10/2004

(Continued)

OTHER PUBLICATIONS

International Search Report dated Aug. 12, 2020, for priority International Patent Application No. PCT/EP2020/062509.

(Continued)

*Primary Examiner* — Justin Seo
*Assistant Examiner* — Tracey M Mcmillion
(74) *Attorney, Agent, or Firm* — Renner, Otto, Boisselle & Sklar, LLP

(57) ABSTRACT

An apparatus for digital printing of carton-based packaging material for packages holding liquid food products is provided. The packaging material has a first side adapted to form outer surfaces of the packages and a second side adapted to form inner surfaces of the packages. The apparatus includes an inlet configured to receive a web of the packaging material and an outlet configured to transfer the web of packaging material out of the apparatus, a web feeding assembly, arranged to feed the web in a web feeding direction from the inlet through the apparatus to the outlet, including at least one drive unit and at least one web direction device, a number of print bars provided with print heads arranged to provide food graded ink on the first side of the web, wherein the at least one drive unit and at least one web direction device provide a first web turning (Continued)

arrangement for turning the web after being received via the inlet such that the first side of the web is facing towards the print heads, and a second web turning arrangement for turning the web after the food graded ink has been provided by the print heads, wherein the first web turning arrangement provides a first slack upstream the number of print bars and the second web turning arrangement provides a second slack downstream the number of print bars.

13 Claims, 3 Drawing Sheets

(56) References Cited

U.S. PATENT DOCUMENTS

| | | | | |
|---|---|---|---|---|
| 2011/0128337 | A1 | 6/2011 | Muir et al. | |
| 2012/0012634 | A1* | 1/2012 | Hatada | B65H 19/10 226/115 |
| 2015/0336403 | A1* | 11/2015 | Saito | H01J 37/32532 118/620 |

FOREIGN PATENT DOCUMENTS

| | | | |
|---|---|---|---|
| CN | 1798657 | A | 7/2006 |
| CN | 102700974 | A | 10/2012 |
| CN | 202702880 | U | 1/2013 |
| CN | 105082793 | A | 11/2015 |
| CN | 213228033 | U | 5/2021 |
| DE | 19929272 | A1 | 12/2000 |
| EP | 0962326 | A2 | 12/1999 |
| EP | 1628833 | A1 | 3/2006 |
| WO | 2004106073 | A1 | 12/2004 |

OTHER PUBLICATIONS

Office Action for corresponding CN Application No. 202010337433.1 with attached Search Report, dated Jan. 30, 2023.

* cited by examiner

APPARATUS FOR DIGITAL PRINTING OF CARTON-BASED MATERIAL AND A METHOD THEREOF

TECHNICAL FIELD

The invention generally relates to the field of packaging technology, such as food packaging technology. More particularly, it is presented methods and apparatuses for digital printing of carton-based packaging material for packages holding liquid food products.

BACKGROUND ART

Today it is commonly known to use roll-fed packaging machines for different types of food products, e.g. milk. The roll-fed packaging machines, also referred to as filling machines, have several advantages. One is that a continuous production of packages makes it possible to achieve higher speeds compared to blanks-fed packaging systems. Another advantage is that by continuously filling a tube of packaging material and forming packages in a lower end of the tube, a risk that unwanted microorganisms enter the packages can be lowered.

The packaging material is today most often printed using so-called flexography in packaging material production centers, sometimes also referred to as converting factories, for carton-based packaging material. After being printed and in other ways prepared for holding food products, for example being laminated such that an inner plastic layer is formed between a carton layer of the packaging material and the food product, the packaging material is loaded on to a reel and shipped to a site where a packaging machine is placed.

Instead of having the packaging material printed, e.g. by using flexography, and prepared in the packaging material production centers, it has been suggested to use digital printing for printing the packaging material. An advantage of using digital printing instead of flexography is that smaller batches may be printed in a cost efficient manner.

Even though it is known to use digital printing for printing the packaging material, there is a number of challenges that needs to be overcome. One of these challenges is to design the apparatus for digital printing such that this may be added to existing lines without requiring costly modifications and rebuilding of the packaging machine and or the building, in which the packaging machine is placed.

SUMMARY

It is an object to at least partly overcome one or more of the above-identified limitations of the prior art. In particular, it is an object to provide an apparatus for digital printing of packaging material that is designed in a compact manner and that can assure cost efficient packaging processes.

According to a first aspect it is provided an apparatus for digital printing of carton-based packaging material for packages holding liquid food products, wherein the packaging material has a first side adapted to form outer surfaces of the packages and a second side adapted to form inner surfaces of the packages, the apparatus comprising an inlet configured to receive a web of the packaging material and an outlet configured to transfer the web of packaging material out of the apparatus, a web feeding assembly, arranged to feed the web in a web feeding direction from the inlet through the apparatus to the outlet, comprising at least one drive unit and at least one web direction device, a number of print bars provided with print heads arranged to provide food graded ink on the first side of the web, wherein the at least one drive unit and at least one web direction device provide a first web turning arrangement for turning the web after being received via the inlet such that the first side of the web is facing towards the print heads, and a second web turning arrangement for turning the web after the food graded ink has been provided by the print heads, wherein the first web turning arrangement provides a first slack upstream the number of print bars and the second web turning arrangement provides a second slack downstream the number of print bars.

The apparatus may further comprise a pre-treatment device arranged upstream the printer bars and downstream the first slack.

The at least one drive unit may be arranged to feed the web in a reversed web feeding direction (A') of the web between the first and second slack after an external downstream stop.

The at least one drive unit may be arranged, after having fed the web between the first and second slack in the reversed direction, to feed the web in the web feeding direction between the first and second slack for a predetermined period of time before the web is fed in the web feeding direction between the inlet and the outlet.

The at least one drive unit may be arranged to feed the web in the web feeding direction between the second slack and the outlet for a predetermined period of time after an internal stop in the apparatus or after an external upstream stop.

The at least one drive unit may be arranged to feed the web in the web feeding direction between the first slack and the outlet after the external upstream stop.

The apparatus may further comprise a web tension arrangement arranged to provide for that the web is placed according to a setpoint with respect to the print heads, and placed downstream the first slack and upstream the second slack, wherein a tension or a slackening of the web caused by the web tension arrangement is compensated for by the first and/or second slack.

The apparatus may further comprise a number of curing devices provided with curing heads arranged for curing the food graded ink provided on the first side, wherein the curing heads are placed downstream the print heads and upstream the second slack.

The first web turning arrangement may be configured to turn the web 180 degrees, and/or the second web turning arrangement may be configured to turn the web 180 degrees.

At least part of the number of print bars may be placed above at least part of the number of curing devices.

According to a second aspect it is provided a method for digital printing of carton-based packaging material for packages holding liquid food products, wherein the packaging material has a first side adapted to form outer surfaces of the packages and a second side adapted to form inner surfaces of the packages, the method comprising receiving a web of packaging material via an inlet, feeding the web from the inlet to an outlet in web feeding direction by using a web feeding assembly comprising at least one drive unit and at least one web direction device, turning the web by using a first web turning arrangement, wherein the first web turning arrangement forms part of the web feeding assembly, after being received via the inlet such that the first side of the web is facing towards print heads of printer bars, forming a first slack of the web, wherein the first slack is placed upstream the print heads, providing food graded ink on the first side of the web by using the number of print bars provided with the print heads, turning the web by using a second web turning arrangement, wherein the second web turning arrangement forms part of the web feeding assembly, after having provided the food graded ink on the first side, forming a second slack of the web, wherein the second slack is placed downstream the print heads and upstream the outlet, and transferring the web via the outlet.

The method may further comprise pre-treating the web by using a pre-treatment device arranged upstream the printer bars and downstream the first slack.

The method may further comprise, in case of an external downstream stop, feeding the web in a reversed web feeding direction between the first and second slack, feeding the web in the web feeding direction between the first and second slack for a pre-determined period of time, and feeding the web in the web feeding direction between the inlet and the outlet.

The method may further comprise, in case of an internal stop or an external upstream stop, feeding the web in the web feeding direction between the second slack and the outlet for a predetermined period of time.

The method may further comprise, in case of the external upstream stop, feeding the web in the web feeding direction between the first slack and the outlet.

Still other objectives, features, aspects and advantages will appear from the following detailed description as well as from the drawings.

BRIEF DESCRIPTION OF THE DRAWINGS

Embodiments will now be described, by way of example, with reference to the accompanying schematic drawings, in which.

DETAILED DESCRIPTION

Figure 1:
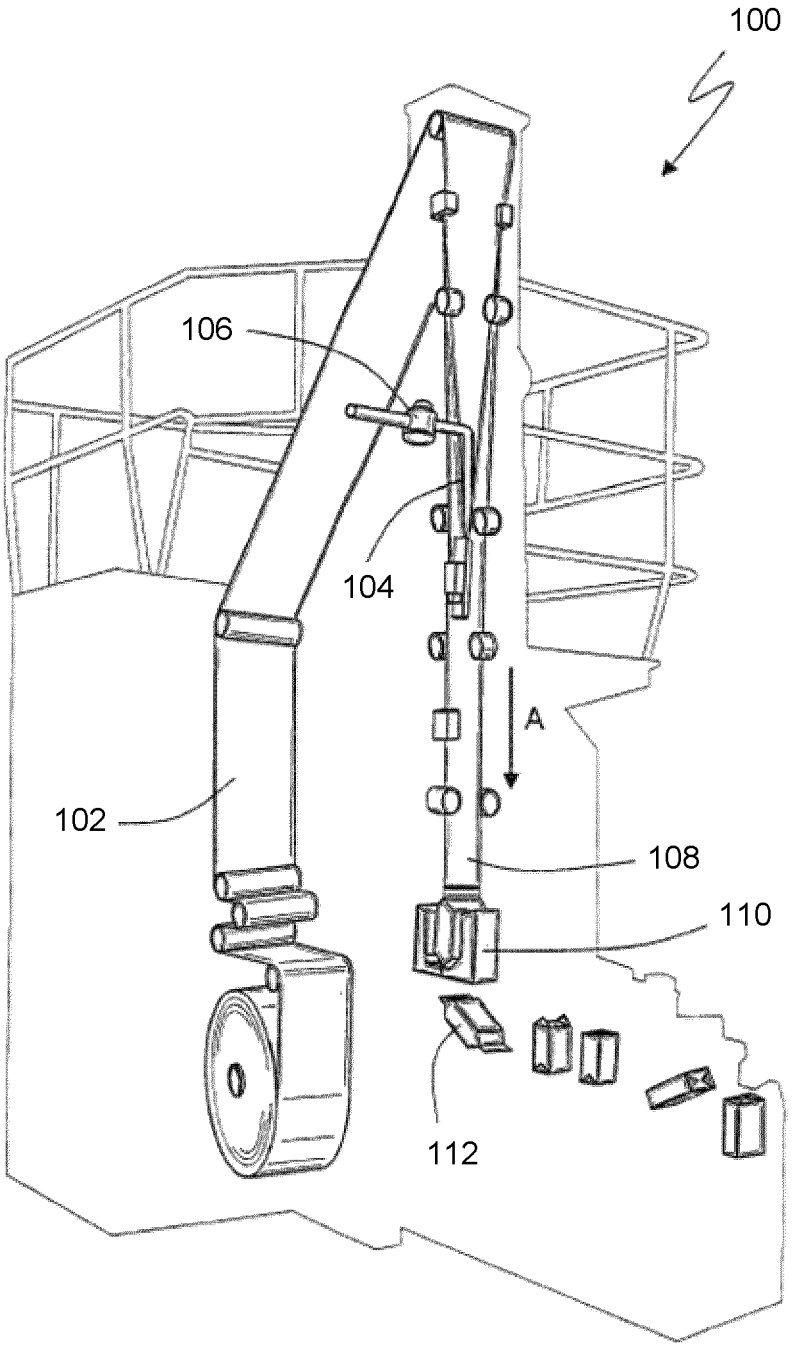
FIG. 1 is a general illustration of a roll-fed packaging machine.

With reference to FIG. 1, a packaging machine 100, sometimes also referred to as a filling machine, is generally illustrated by way of example. The packaging machine 100 is a roll-fed packaging machine used for packaging liquid food products in carton-based packages. Already in the 1940s this type of packaging machines was introduced by Tetra Pak, and it is today a well-known approach for packaging milk and other liquid food products in a safe and cost-efficient manner. The general approach can also be used for non-liquid food products, such as potato crisps.

Today, packaging material is often printed and prepared in packaging material production centers, also referred to as converting factories, and is shipped to a site where the packaging machine 100 is placed, e.g. a dairy. Usually the packaging material is loaded onto a reel before being transported. After arriving at the site, the reel is placed in the packaging machine as illustrated in FIG. 1.

During production a web 102 of packaging material can be fed from the reel through the packaging machine in a web feeding direction A. Even though not illustrated in FIG. 1, the packaging material may pass through a sterilization device, e.g.

a hydrogen peroxide bath or an LVEB (Low-Voltage Electron Beam) station, for ensuring that the web 102 is free from unwanted microorganisms. Before providing the food product, a tube can be formed from the web 102 by forming a longitudinal sealing. The food product can be fed into the tube via a pipe 104 and a valve 106 may be used for regulating a flow through the pipe 104. A lower end 108 of the tube can be fed into a folding device 110 in which a transversal sealing is made, the tube is folded according to folding lines, also referred to as weakening lines or creasing lines, and cut off such that packages 112 can be formed. Even though the folding device 110 is illustrated as one single device, the folding device 110 may comprise a number of different devices.

Figure 2A:
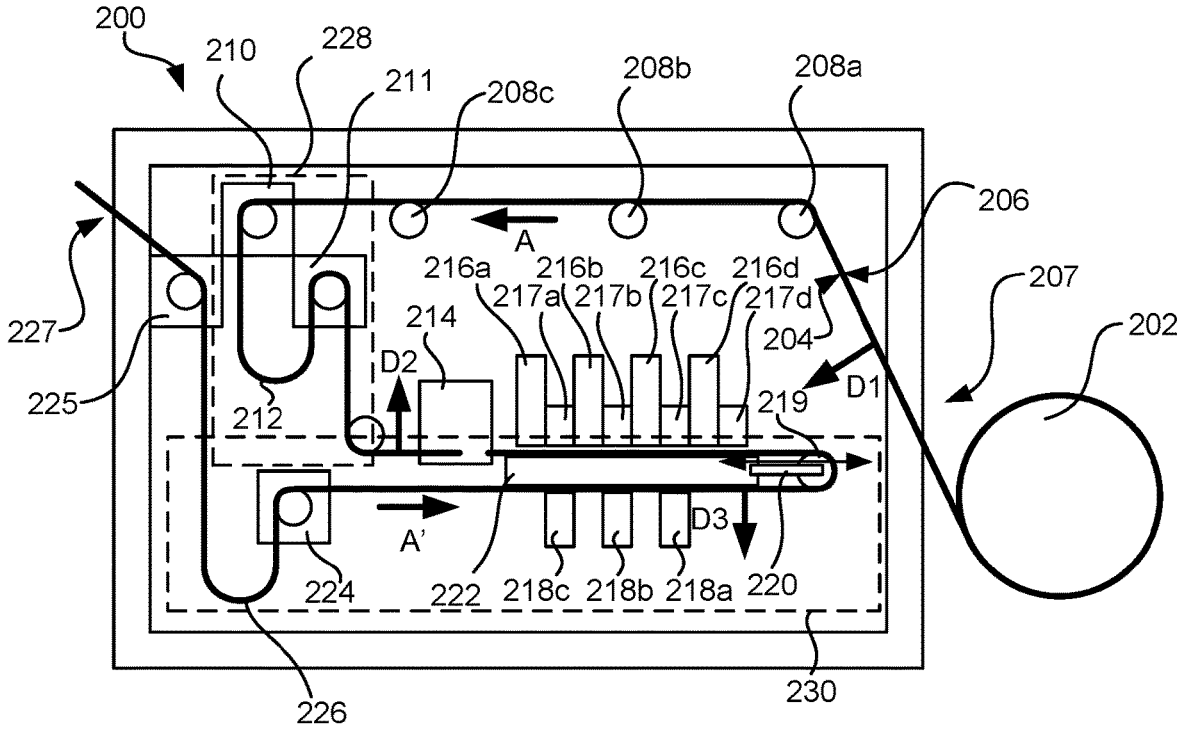
FIGS. 2*a* and 2*b* are side views of two embodiments of an apparatus for digital printing of carton-based packaging material for packages holding liquid food products.
Figure 2B:
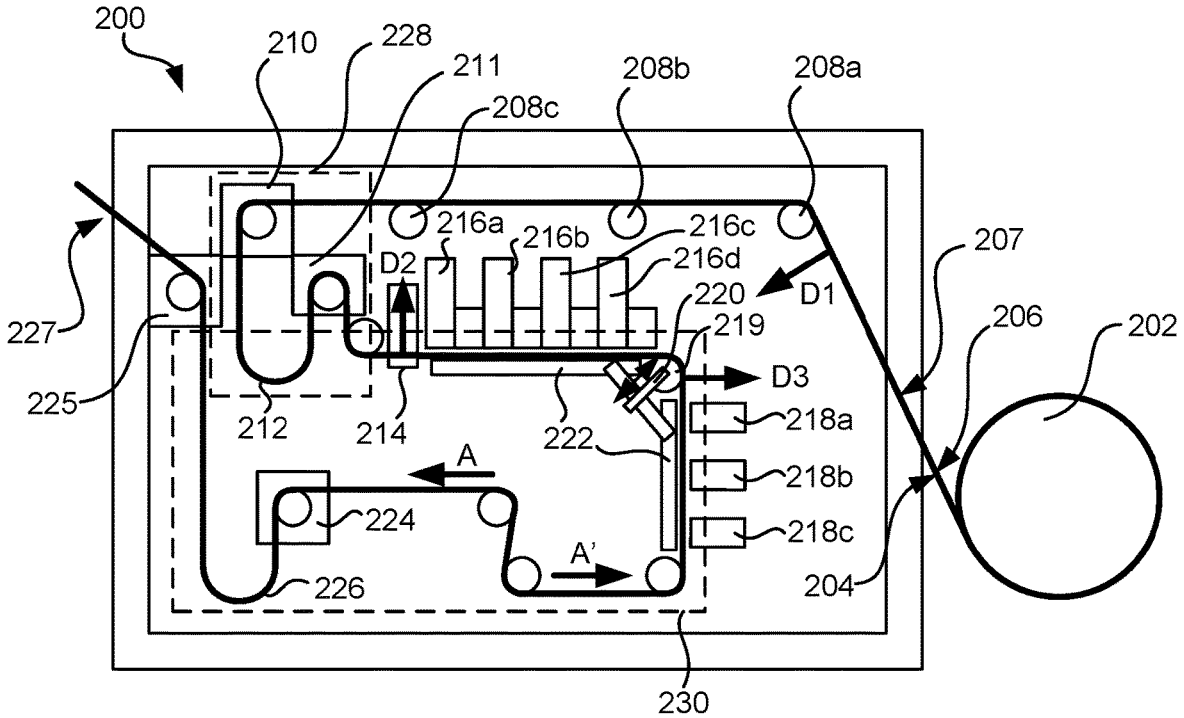

Instead of having the web 102 of packaging material printed in packaging material production centers, i.e. off-site printed, the web 102 can be printed on-site using e.g. digital printing in an apparatus 200 as illustrated in FIGS. 2*a* and 2*b*. The apparatus 200 can be arranged such that the web 102 is fed via the apparatus 200 into the packaging machine 100.

Packaging material may be fed into the apparatus 200 via a reel 202. The packaging material may be partly printed, i.e. sections of the packaging material is printed in packaging material production centers, or the packaging material may be without printing, such that all printing is made by the apparatus 200.

The packaging material may be loaded on to the reel 202 such that a first side 204, adapted to form outer surfaces of the packages 112, is facing outwards, and a second side 206, adapted to form inner surfaces of the packages 112, is facing inwards. The web 102 can be fed into the apparatus 200 via an inlet 207 with the first side 204 facing downwards.

In the apparatus 200, the web 102 may be fed forward by a web feeding assembly. The web feeding assembly may comprise a first roller 208*a*, a second roller 208*b*, a third roller 208*c* or any other type of web direction device, and a first drive unit 210, a second drive unit 211, a third drive unit 224, and a fourth drive unit 225 that together are providing for that the web is fed through the apparatus 200 as well as unloaded from the reel 202. To be able to compensate for that different steps in the apparatus 200 may require different amounts of time at different occasions, the web 102 may form a first slack 212 downstream the first drive unit 210. The first slack 212 may be formed between the inlet 207 and a pre-treatment device 214.

From the first slack 212, the web 102 may be fed into the pre-treatment device 214 in which the packaging material is pre-treated such that printing can be made in subsequent stations downstream the pre-treatment device 214. As illustrated, the printing may be provided by using a number of print bars, herein by example four print bars 216*a*, 216*b*, 216*c*, 216*d*, in combination with a number of pinning devices providing for an initial curing, herein by example four pinning devices 217*a*, 217*b*, 217*c*, 217*d*. The print bars 216*a*, 216*b*, 216*c*, 216*d* can be provided with print heads that are facing downwards such that these can provide for that the first side 204 is printed with food graded ink when passing the print bars.

As illustrated in FIG. 2*a*, after being printed the web can be turned such that the first side is facing downwards. By using a number of curing devices, herein by example three curing devices 218*a*, 218*b*, 218*c*, the food graded ink provided by the print bars 216*a*, 216*b*, 216*c*, 216*d* can be cured. The curing devices 218*a*, 218*b*, 218*c* can be provided with curing heads facing upwards such that the curing heads are facing the first side 204 of the packaging material. The curing devices 218*a*, 218*b*, 218*c* can be an energy curing for example electron beam or UV light.

The web 102 may be turned by using a fourth roller 219, or any other type of web direction device, placed downstream the print bars 216*a*, 216*b*, 216*c*, 216*d* and upstream the curing devices 218*a*, 218*b*, 218*c*. The fourth roller 219 may form part of a web tension arrangement 220 that can be used to provide for that the web 102 is tensioned when printing, pinning and/or curing, and/or the fourth roller 219 may form part of the web feeding assembly.

The web tension arrangement 220 may comprise a shielding arrangement 222 that is hindering emission, for example the UV light, from the curing devices 218*a*, 218*b*, 218*c* from reaching the print heads of the print bars 216*a*, 216*b*, 216*c*, 216*d*. The shielding arrangement 222 may e.g. be metal plates placed between the curing heads and the print heads.

The web tension arrangement 220 may be embodied in various ways. By way of example, as illustrated in FIGS. 2*a* and 2*b*, the web 102 may be tensioned by moving the fourth roller 219 such that the web is tensioned or loosened, in turn providing for that the web 102 can be placed correctly with respect to the print heads and/or the curing heads. Put differently, the web tension arrangement 220 can provide for that the web 102 is placed according to a set point.

After being cured, the web 102 can be fed via the third drive unit 224, that can form part of the web feeding assembly, to a second slack 226 and thereafter out of the apparatus 200 via an outlet 227. An advantage with the second slack 226 is that this makes it possible to compensate for minor stops in the packaging machine 100 placed downstream, as well as speed variations within the apparatus 200.

A general advantage with the apparatus 200 is that the print bars 216*a*, 216*b*, 216*c*, 216*d* may be placed above the curing devices 218*a*, 218*b*, 218*c*, which provides for that a compact design can be achieved. Further, by redirecting the web twice the packaging material can be provided in the same manner as of today, i.e. provided on the reel 202 with the first side 204 facing outwards, and also the packaging machine 100 can be provided in the same manner as of today, i.e. receiving the web with the first side 204 facing downwards. Another advantage with the design is therefore that few or no modifications are required in the packaging machine 100 and in the packaging material production centers.

As illustrated in FIG. 2*a* and as explained above, the web 102 may be turned 180 degrees after passing the print heads and before passing the curing heads such that e.g. the printer bars 216*a*, 216*a*, 216*c*, 216*d* can be placed above the curing devices 218*a*, 218*b*, 218*c*. Put differently, a normal vector of the first side 204 may be directed in a first direction D1 when being fed into the apparatus 200 via the inlet 207. By using the web feeding assembly the web 102 may be redirected such that the normal vector is directed in a second direction D2 when reaching the print heads of the printer bars 216*a*, 216*b*, 216*c*, 216*d*. After printing, i.e. downstream the print heads, the web 102 may be redirected such that the normal vector of the first side 204 is directed in a third direction D3. If having the printer bars placed above the curing devices as illustrated in FIG. 2*a*, the second direction D2 and the third direction D3 may represent two opposite directions, i.e. 180 degrees apart from each other.

FIG. 2*b* illustrates another example of how the apparatus may be designed. In the example illustrated in FIG. 2*b*, the printer bars 216*a*, 216*b*, 216*c*, 216*d* are placed such that the print heads are facing downwards, in line with the print heads of the apparatus 200 illustrated in FIG. 2*a*, but unlike the apparatus 200 illustrated in FIG. 2*a*, the curing devices 218*a*, 218*b*, 218*c* are placed such that the curing heads are facing horizontally such that the web 102 may be cured while this is moving vertically, more particularly, in this example, downwards. Put differently, instead of redirecting the web 102 such that the normal vector of the first side is shifted 180 degrees, as illustrated in FIG. 2*a*, the normal vector is redirected 90 degrees.

Further, even though not illustrated, it is also possible to have both the print bars 216*a*, 216*b*, 216*c*, 216*d* and the curing devices 218*a*, 218*b*, 218*c* horizontally placed and opposite to each other, and redirecting the web 180 degrees downstream the printer bars 216*a*, 216*b*, 216*c*, 216*d* and upstream the curing devices 218*a*, 218*b*, 218*c*.

Even though the examples above are related to redirecting the normal vector downstream the printer heads and upstream the curing heads 90 or 180 degrees, it is to be understood that this only examples and that the web 102 may be directed not only according to these specified examples, e.g. in several minor steps of less than 90 degrees.

An advantage with having the first and the second slack 212, 226 is that an external upstream stop may be handled efficiently, e.g. the printing and curing may continue even though feeding of the web is interrupted by that the reel 202 is to be changed. By having the first slack 212 it is namely possible to halt the feeding of the web from the inlet 207 to the first slack 212, but continue to feed the web 102 from the first slack 212 to the print heads and throughout the apparatus 200. An effect of halting feeding of the web 102 between the inlet 207 and the first slack 212 is that the first slack 212 is reduced, i.e. less packaging material are provided in the first slack 212. In order to compensate for that the packaging material in the first slack has been reduced it is possible, once feeding between the inlet 207 and the first slack 212 is re-started, to feed the web with higher speed between the inlet and the first slack for a period of time such that the packaging material provided in the first slack is increased to a level held before the feeding between the inlet and first slack was halted. The first slack 212, as well as the second slack 226, may comprise packaging material corresponding to at least one package 112 and a maximum amount of packaging material in the first slack 212, as well as the second slack 226, may be set such that the packaging material can hang freely, i.e. the maximum amount of packaging material can be set based on what a design of the apparatus 200 allows for.

Turning or re-directing the web 102 is therefore not only beneficial from a foot print perspective, i.e. that a compact design can be achieved, and that no or few modifications of the packaging machine 100 are required, but also in that the first and second slack 212, 226 can be formed such that interruptions can be handled efficiently and compensated for.

In case of an internal stop, e.g. a quality control is made that is requiring that the web 102 is halted between the first and second slack 212, 226, this may be handled by that the web 102 continues to be fed from the inlet 207 to the first slack 212 and, as an effect, that packaging material held in the first slack 212 is increased, and/or that the web 102 continues to be fed from the second slack 226 to the outlet 227 such that the packaging material in the second slack 226 is reduced.

In case of an external downstream stop, e.g. the filling machine 100 is halted, the web 102 may be halted as well and thereafter the web 102 may be fed in a reversed direction A' between the second slack 226 and the first slack 112. An advantage with this is that a part of the web 102 that has been pre-treated by the pre-treatment device 214, but not printed and cured may be pre-treated again such that a time between pre-treatment and printing is not extended due to the halting of the filling machine 100. If extending the time between pre-treatment and printing above a time threshold, the printing will namely be negatively affected.

Therefore, in case of the external downstream stop, the web 102 may be fed in the reversed direction A' between the second and first slack 226, 212 and thereafter fed in the direction A between the first and second slack 212, 226 such that packaging material levels in the first and second slacks are reverted back to levels held before the external downstream stop. After having adjusted the levels in the first and second slack 212, 226 and the external downstream stop is removed, the web 102 may be fed in the direction A between the inlet 207 and the outlet 227.

As illustrated in FIGS. 2*a* and 2*b*, the web 102 may be turned by using the first and the second drive unit 210, 211 such that the first side 204 is facing towards the print heads. These two together with other web direction devices used may together generally be referred to as a first web turning arrangement 228. The fourth roller 219 may, as illustrated in FIGS. 2*a* and 2*b*, form part of a second web turning arrangement 230 arranged for turning the web 102 after the food graded ink has been provided by the print heads. The second web turning arrangement 230 may, as illustrated in FIG. 2*a*, turn the web 102 180 degrees by using a single roller, in this particular example the fourth roller 219. Another option, as illustrated in FIG. 2*b*, is to turn the web 102 in several stages. As illustrated in FIG. 2*b*, the web 102 is turned 90 degrees by using the fourth roller 219 and thereafter 90 degrees using another roller. Further, by way of example, the first slack 212, which is provided by the first web turning arrangement 228, may be provided as part of the turning of the web, or as is the case for the second web turning arrangement 230, which provides the second slack 226, the second slack 226 may be provided after the web 102 has been turned.

Figure 3:
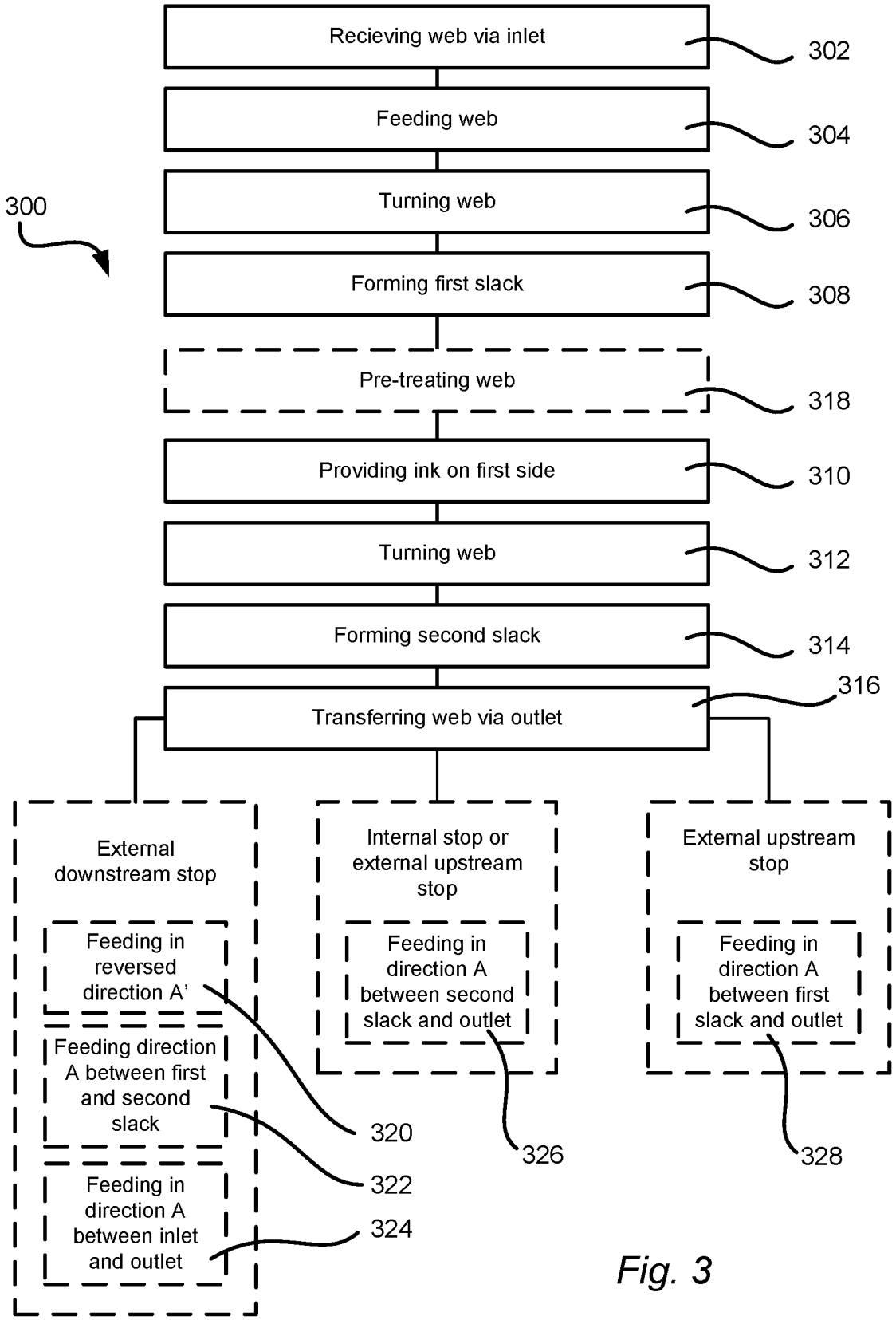
FIG. 3 is a flow chart illustrating a method for digital printing of carton-based packaging material.

In FIG. 3 it is presented a flowchart illustrating a method for digital printing of carton-based packaging material for packages 112 holding liquid food products by way of example. In a first step 302 the web 102 of packaging material can be received via the inlet 207. In a second step 304, the web 102 can be fed from the inlet 207 to the outlet 227 in the web feeding direction A by using the web feeding assembly 208*a*, 208*b*, 208*c*, 210, 211, 219, 224, 225, comprising the at least one drive unit 210, 211, 224, 225 and the at least one web direction device 208*a*, 208*b*, 208*c*, 219. In a third step 306, the web can be turned by using the first web turning arrangement 228, wherein the first web turning arrangement forms part of the web feeding assembly, after being received via the inlet 207 such that the first side 204 of the web 102 is facing towards the print heads of the printer bars 216*a*, 216*b*, 216*c*, 216*d*. In a fourth step 308, the first slack 212 of the web 102 can be formed, wherein the first slack 212 is placed upstream the print heads. In a fifth step 310, food graded ink can be provided on the first side 204 of the web 102 by using the number of print bars 216*a*, 216*b*, 216*c*, 216*d* provided with the print heads. In a sixth step 312, the web can be turned by using the second web turning arrangement 230, wherein the second web turning arrangement forms part of the web feeding assembly, after having provided the food graded ink on the first side 204. In a seventh step 314, the second slack 226 of the web 102 can be formed, wherein the second slack 212 can be placed downstream the print heads and upstream the outlet 227. In an eighth step 316, the web can be transferred via the outlet 227.

Optionally, in a ninth step 318, the web 102 may be pre-treated by using a pre-treatment device 214 arranged upstream the printer bars 216*a*, 216*b*, 216*c*, 216*d* and downstream the first slack 212.

Optionally, in case of the external downstream stop, in a tenth step 320, the web 102 may be fed in a reversed web feeding direction A' between the first and second slack 212, 226. Thereafter, in an eleventh step 322, the web may be fed in the web feeding direction A between the first and second slack 212, 226 for a pre-determined period of time, and, in a twelfth step 324, the web may be fed in the web feeding direction A between the inlet 207 and the outlet 227.

Optionally, in case of an internal stop or an external upstream stop, in a thirteenth step 326, the web 102 may be fed in the web feeding direction A between the second slack 226 and the outlet 227 for a predetermined period of time.

Optionally, in case of the external upstream stop, in a fourteenth step 328, the web 102 may be fed in the web feeding direction A between the first slack 212 and the outlet 227.

Even if described in a specific order it is to be understood that the steps do not have to be performed in this order.

From the description above follows that, although various embodiments of the invention have been described and shown, the invention is not restricted thereto, but may also be embodied in other ways within the scope of the subject-matter defined in the following claims.

The invention claimed is:

1. An apparatus for digital printing of carton-based packaging material for packages holding liquid food products, wherein the packaging material has a first side adapted to form outer surfaces of the packages and a second side adapted to form inner surfaces of the packages, the apparatus comprising an inlet configured to receive a web of the packaging material and an outlet configured to transfer the web of packaging material out of the apparatus, a web feeding assembly, arranged to feed the web in a web feeding direction from the inlet through the apparatus to the outlet, comprising at least one drive unit and at least one web direction device a number of print bars provided with print heads arranged to provide food graded ink on the first side of the web, wherein the at least one drive unit and at least one web direction device provide a first web turning arrangement for turning the web after being received via the inlet such that the first side of the web is facing towards the print heads, and a second web turning arrangement for turning the web after the food graded ink has been provided by the print heads, wherein the first web turning arrangement provides a first slack upstream the number of print bars and the second web turning arrangement provides a second slack downstream the number of print bars, and wherein the at least one drive unit is arranged to feed the web in a reversed web feeding direction of the web between the first and second slack after an external downstream stop.

2. The apparatus according to claim 1, further comprising a pre-treatment device arranged upstream the printer bars and downstream the first slack.

3. The apparatus according to claim 1, wherein the at least one drive unit is arranged, after having fed the web between the first and second slack in the reversed direction, to feed the web in the web feeding direction A between the first and second slack for a pre-determined period of time before the web is fed in the web feeding direction between the inlet and the outlet.

4. The apparatus according to claim 1, wherein the at least one drive unit is arranged to feed the web in the web feeding direction between the second slack and the outlet for a predetermined period of time after an internal stop in the apparatus or after an external upstream stop.

5. The apparatus according to claim 1, wherein the at least one drive unit is arranged to feed the web in the web feeding direction between the first slack and the outlet after the external upstream stop.

6. The apparatus according to claim 1, further comprising a web tension arrangement arranged to provide for that the web is placed according to a setpoint with respect to the print heads, and placed downstream the first slack and upstream the second slack, wherein a tension or a slackening of the web caused by the web tension arrangement is compensated for by the first and/or second slack.

7. The apparatus according to claim 1, further comprising a number of curing devices provided with curing heads arranged for curing the food graded ink provided on the first side, wherein the curing heads are placed downstream the print heads and upstream the second slack.

8. The apparatus according to claim 7, wherein at least part of the number of print bars are placed above at least part of the number of curing devices.

9. The apparatus according to claim 1, wherein the first web turning arrangement is configured to turn the web 180 degrees, and/or the second web turning arrangement is configured to turn the web 180 degrees.

10. A method for digital printing of carton-based packaging material for packages holding liquid food products, wherein the packaging material has a first side adapted to form outer surfaces of the packages and a second side adapted to form inner surfaces of the packages, the method comprising receiving a web of packaging material via an inlet, feeding the web from the inlet to an outlet in web feeding direction by using a web feeding assembly, comprising at least one drive unit and at least one web direction device, turning the web by using a first web turning arrangement, wherein the first web turning arrangement forms part of the web feeding assembly, after being received via the inlet such that the first side of the web is facing towards print heads of printer bars, forming a first slack of the web, wherein the first slack is placed upstream the print heads, providing food graded ink on the first side of the web by using the number of print bars provided with the print heads, turning the web by using a second web turning arrangement, wherein the second web turning arrangement forms part of the web feeding assembly, after having provided the food graded ink on the first side, forming a second slack of the web, wherein the second slack is placed downstream the print heads and upstream the outlet, and transferring the web via the outlet, and in case of an external downstream stop, feeding the web in a reversed web feeding direction between the first and second slack feeding the web in the web feeding direction between the first and second slack for a pre-determined period of time, and feeding the web in the web feeding direction between the inlet and the outlet.

11. The method according to claim 10, further comprising pre-treating the web by using a pre-treatment device arranged upstream the printer bars and downstream the first slack.

12. The method according to claim 10, further comprising in case of an internal stop or an external upstream stop, feeding the web in the web feeding direction between the second slack and the outlet for a predetermined period of time.

13. The method according to claim 10, further comprising in case of the external upstream stop, feeding the web in the web feeding direction between the first slack and the outlet.

* * * * *